United States Patent [19]

Bishop

[11] 4,331,006

[45] May 25, 1982

[54] SHOCK ABSORBER ASSEMBLY

[75] Inventor: Thomas R. Bishop, Houston, Tex.

[73] Assignee: Bowen Tools, Inc., Houston, Tex.

[21] Appl. No.: 165,200

[22] Filed: Jul. 1, 1980

[51] Int. Cl.[3] ..... F16D 3/06; E21B 17/00

[52] U.S. Cl. ..... 464/18; 175/321; 267/125; 464/24

[58] Field of Search ..... 64/23, 23.5; 267/125; 175/321

[56] References Cited

U.S. PATENT DOCUMENTS

| | | | |
|---|---|---|---|
| 2,025,100 | 12/1935 | Gill et al. | 64/23 |
| 2,520,306 | 8/1950 | Detweiler | 277/176 |
| 2,568,256 | 9/1951 | Shaffer | 175/321 |
| 2,712,435 | 7/1955 | Allen | 64/23 |
| 2,712,435 | 7/1955 | Allen | 64/23 |
| 2,987,129 | 6/1961 | Webb | 175/321 |
| 3,033,011 | 5/1962 | Garrett | 64/11 R |
| 3,225,566 | 12/1965 | Leathers | 64/23 |
| 3,254,508 | 6/1966 | Garrett | 175/321 |
| 3,281,166 | 10/1966 | Doughty, Jr. et al. | 285/114 |
| 3,350,900 | 11/1967 | Harrison | 64/23 |
| 3,606,297 | 9/1971 | Webb | 267/125 |
| 3,815,692 | 6/1974 | Varley | 175/321 |
| 3,949,150 | 4/1976 | Mason et al. | 175/321 |
| 3,998,443 | 12/1976 | Webb | 267/125 |
| 4,031,716 | 6/1977 | Zabcik | 64/23 |
| 4,054,040 | 10/1977 | Medders | 175/321 |
| 4,055,338 | 10/1977 | Dyer | 64/23 |
| 4,067,405 | 1/1978 | Bassinger | 175/321 |
| 4,130,000 | 12/1978 | Burge | 64/23 |
| 4,133,516 | 1/1979 | Jurgens | 267/125 |
| 4,145,034 | 3/1979 | Dyer | 267/125 |
| 4,171,025 | 10/1979 | Bassinger | 175/321 |
| 4,173,130 | 11/1979 | Sutliff et al. | 175/321 |

*Primary Examiner*—Ira S. Lazarus

*Attorney, Agent, or Firm*—Pravel, Gambrell, Hewitt, Kirk & Kimball

[57] ABSTRACT

A shock absorber assembly for absorbing shocks encountered by a drill string having a working fluid flowing therethrough wherein the shock absorber assembly includes a housing affixed to the drill string, a mandrel mounted for reciprocal longitudinal movement with respect to the housing, and a fluid dampening member replaceably sandwiched between the mandrel and housing for absorbing shocks transmitted between the mandrel and the housing during drilling operations.

11 Claims, 6 Drawing Figures

SHOCK ABSORBER ASSEMBLY

TECHNICAL FIELD OF THE INVENTION

The technical field of this invention relates to devices used in the absorption of intermittent shocks and vibrations, particularly of the type used in conjunction with the drill string during drilling operations.

DESCRIPTION OF THE PRIOR ART

Shock absorbing devices have long been used in the rotary well drilling industry for reducing shocks and vibrations encountered by the drilling bit during drilling operations while penetrating through rock formations having varying, inconsistent layers. In an effort to reduce the shocks and vibrations, many types of shock absorbing devices have been used. Some devices utilize springs for isolating such shocks between two movable members such as disclosed in U.S. Pat. Nos. 3,281,166 and 4,133,516. Other devices include the use of resilient rubber pads for attempting to isolate such shocks as shown in U.S. Pat. Nos. 3,949,150 and 4,130,000. U.S. Pat. No. 2,712,435 uses a combination of springs and fluid cavities to effectuate the desired shock absorbing function. Other techniques have incorporated what is known as a "floating piston" design such as disclosed in U.S. Pat. Nos. 3,606,297; 3,815,692; 4,031,716; 4,055,338; 4,067,405; 4,145,304; and 4,171,025. U.S. Pat. No. 3,998,443 discloses a multi-directional shock absorbing device while U.S. Pat. No. 3,350,900 utilizes a differential area concept in order to effectuate shock cushioning of a rotary driving well tool. Furthermore, U.S. Pat. No. 3,225,566 discloses a drill string shock absorber utilizing an annular piston adapted to move within an annular chamber that is filled with a compressible fluid, with the action of the annular piston against the compressible fluid providing the dampening force for effectuating the shock absorber function. However, this tool, as well as those shown in the aforementioned patents, all have the shock absorber members formed integrally with the housing member of the shock absorbing tool. Consequently, such shock absorber assemblies encounter dynamic stresses caused by rotary drilling operation in addition to increased stresses and strain due to its shock absorbing function to such a shock absorbing member. Accordingly, so far as known, no effective technique or device has been devised that is capable of reducing or isolating stresses and/or strain due to shock loading on the shock absorber member from normal drilling loading yet is capable of being easily serviced and maintained.

SUMMARY OF THE INVENTION

The present invention relates to a new and improved shock absorber assembly wherein the shock absorber assembly includes a housing having a central bore therethrough and a mandrel mounted for reciprocal longitudinal movement with respect to the housing with a fluid dampening member for absorbing shocks between the mandrel and the housing being replaceably sandwiched between the upper portion of the housing and the mandrel to effectuate the absorption of shocks transmitted between the mandrel and the housing.

DESCRIPTION OF THE PREFERRED EMBODIMENT

Figure 1:
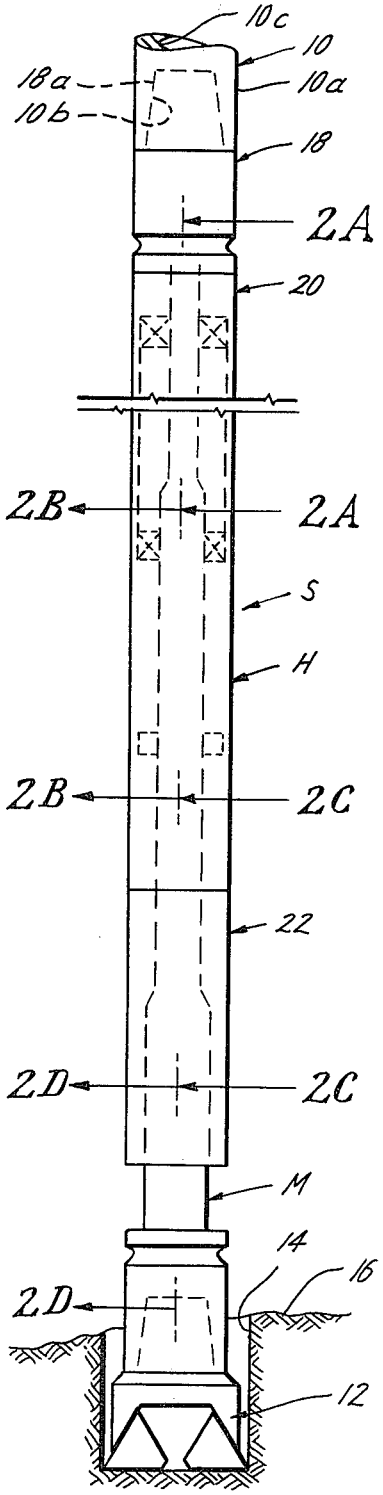
FIG. 1 is an elevational view of the shock absorber assembly of the present invention as schematically used with a drill string, with the fluid dampening means in a fully expanded position.

Referring to the drawings, the shock absorber assembly of the present invention is referred to generally by the letter S. The shock absorber assembly S is adapted to be used with a drill string, such as drill string 10 (FIG. 1) and preferably is positioned between the lower end 10*a* of the drill string 10 and drill bit 12. The drill bit 12, preferably capable of providing cutting action upon rotation and axial loading thereof, is typically utilized for drilling a suitable well bore 14 in geologic formations 16. The shock absorber assembly S may also be positioned at various other locations in the drill string 10 as is necessary to effectuate appropriate shock absorption functions as is deemed necessary under varying conditions. The shock absorber assembly S includes a housing H, a mandrel M mounted for reciprocal movement with respect to the housing H, and fluid dampening means F replaceably sandwiched between the housing H and mandrel M as discussed more fully hereinbelow. Unless otherwise noted, it is preferred that the components of this invention be made of suitable high strength material such as steel or other high grade materials capable of withstanding the significant stresses and strains encountered during typical drilling operations.

The shock absorber assembly S of the present invention includes a housing H. The housing H includes an upper housing portion 18, an intermediate housing portion 20, and a lower housing portion 22. The upper housing portion 18 is affixed with the drill string 10 by threads 18*a* shown schematically in FIG. 1, which engage compatibly formed threads 10*d* in the lower end 10*a* of drill string 10. The upper housing portion 18 is formed having a central bore 18*b* therein which is preferably substantially the same diameter as the bore 10*c* of the drill string 10 and in longitudinal, axial alignment therewith. A radial lip 18*c* is formed adjacent the central bore 18*b* adjacent the lower end 18*d* of the upper housing portion 18. An inner annular surface 18*e* is formed adjacent to the radial lip 18*c* and extends to the annular end surface 18*f* of the upper housing portion 18. Preferably, a suitable detent 18*g* is formed in the inner annular surface 18*e* for the disposition of a suitable sealing member such as an O-ring 18*h*. Outer annular surface 18*i* is formed adjacent to the annular end surface 18*f*, and extends upwardly therefrom to threaded section 18*j*, with outer annular surface 18*k* extending upwardly therefrom. Tapered radial surface 18*l* is formed adjacent to outer annular surface 18*k*. Suitable detents 18*m*, 18*n*, are preferably formed in outer annular surfaces 18*i*, 18*k*, respectively, for receiving suitable sealing members such as O-rings 18*p*, 18*q*, respectively.

Figure 2A:
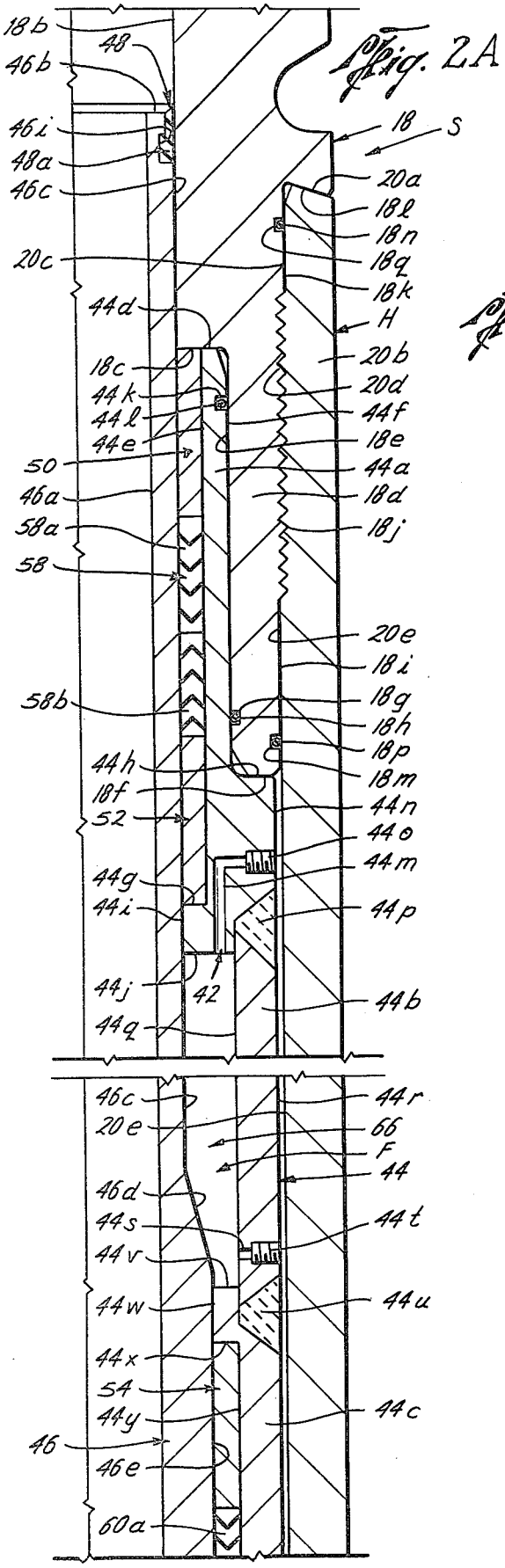
FIG. 2A is an elevational, sectional view of the shock absorber assembly of the present invention as taken along the lines 2A—2A of FIG. 1.

The upper housing portion 18 of the housing H is adapted to threadedly receive the intermediate housing portion 20 as best seen in FIG. 2A. The intermediate housing portion 20 of the housing H includes a tapered radial end surface 20*a* adapted to be in compatible engagement with the tapered radial surface 18*l* of the upper housing portion 18. The tapered radial end surface 20*a* is formed adjacent the upper end 20*b* of the intermediate housing portion 20, with an inner annular surface 20*c* extending downwardly from the tapered radial end surface 20*a*. Suitable threads 20*d* are formed adjacent to annular surface 20*c* for compatible, threaded engagement with the threaded section 18*j* of upper housing portion 18. Intermediate housing bore 20*e* extends downwardly from threads 20*d* along the length of the intermediate housing portion 20 to the lower end 20*f* of the intermediate housing portion 20 where threads 20*g* are formed. An inner annular surface 20*h* is formed adjacent to threads 20*g* with a tapered, radial lower end surface 20*i* formed adjacent thereto. It should be noted that the intermediate housing bore 20*e* of the intermediate housing portion 20 is of a diameter greater than that of the central bore 18*b* of upper housing portion 18 of the housing H. Furthermore, O-rings 18*p*, 18*q* are adapted to engage the intermediate housing bore 20*e* and inner annular surface 20*c*, respectively, to prevent any unwanted fluid migration therebetween.

Figure 2B:
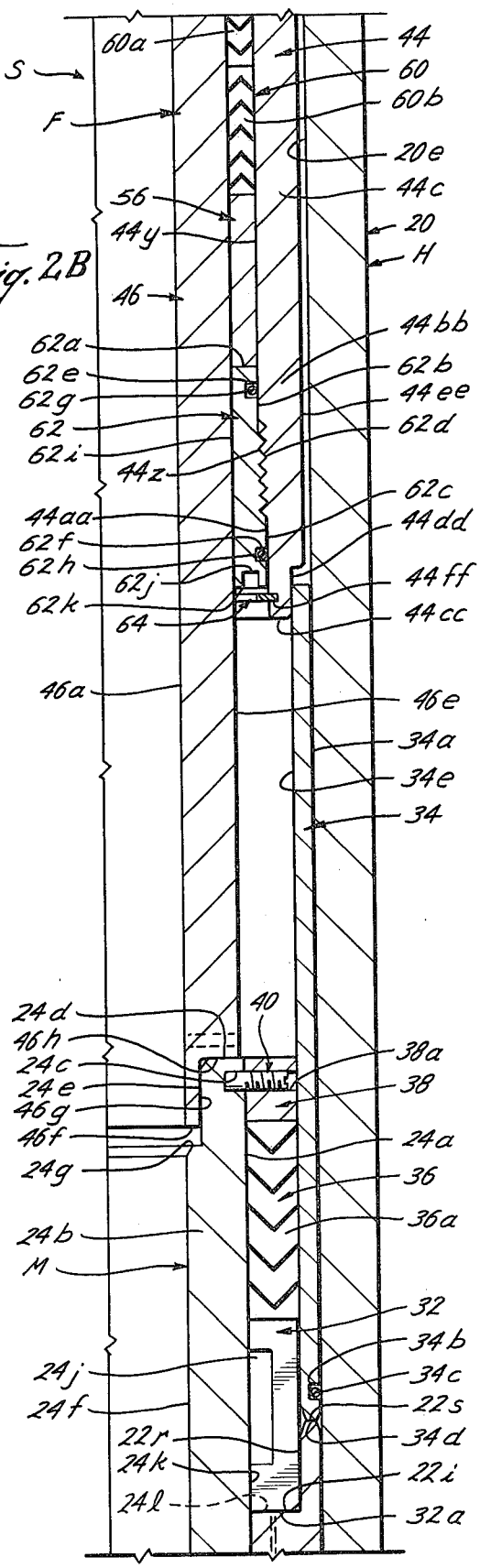
FIG. 2B is an elevational, sectional view of the shock absorber assembly of the present invention as taken along the lines 2B—2B of FIG. 1.
Figure 2C:
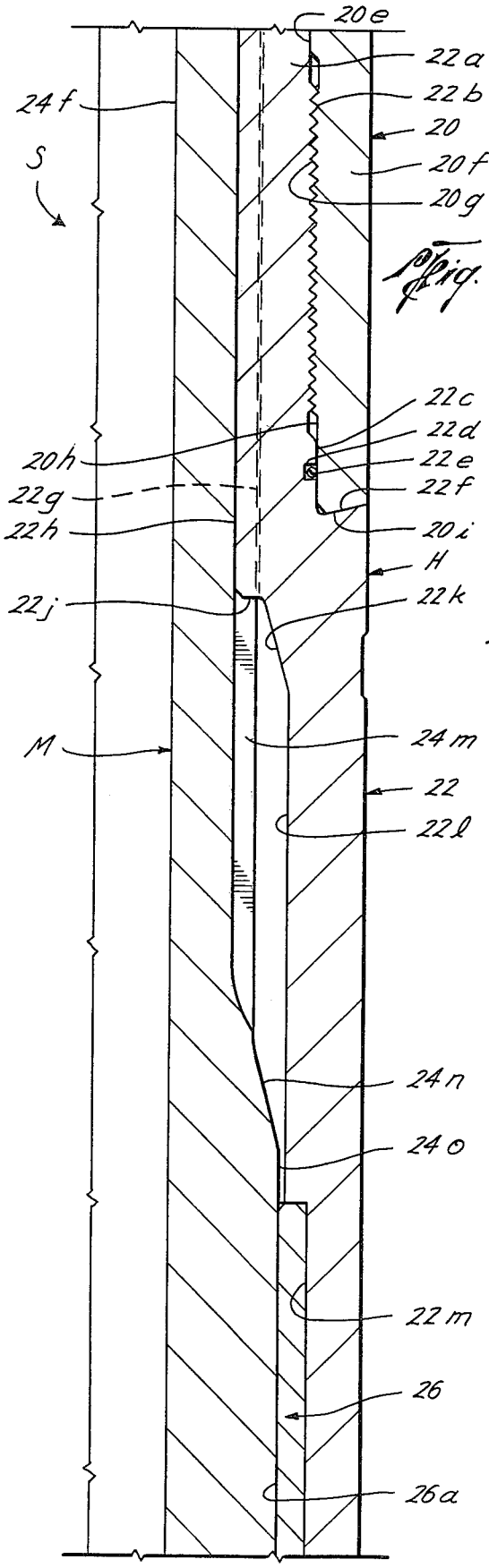
FIG. 2C is an elevational, sectional view of the shock absorber assembly of the present invention taken along the lines 2C—2C of FIG. 1.

The lower housing portion 22 of the housing H is preferably threadedly affixed to the intermediate housing portion 20 as best seen in FIG. 2C. The lower housing portion 22 preferably includes an upper end 22*a* having suitable threads 22*b* formed therewith and adapted to compatibly engage threads 20*g* of theintermediate housing portion 20. Preferably, a suitable annular surface 22*c* is formed adjacent to threads 22*b* with an appropriate detent 22*d* formed within the annular surface 22*c* for receiving a suitable sealing means such as O-ring 22*e*. A tapered, radial surface 22*f* is formed adjacent to annular surface 22*c* and is adapted to engage end surface 20*i* compatibly. Preferably, the upper end 22*a* of the lower housing portion 20 is formed having a plurality of longitudinal slots or splines 22*g* formed adjacent the upper end 22*a* thereof which extends radially outwardly from the lower housing bore 22*h*. Preferably, such slots or splines 22*g* are of a substantially rectangular configuration, but having an arcuate outer surface (not shown) thereof; however, any other suitable configuration slot or spline may alternatively be used. The slots or splines 22*g* extend longitudinally between the radial surface 22*i* (FIG. 2B) along the upper end 22*a* of the lower housing portion 22 to radial surface 22*j* (FIG. 2C), being preferably evenly spaced about the lower housing bore 22H. Preferably, a tapered surface 22*k* is formed adjacent to radial surface 22*j* with an inner annular surface 22*l* formed adjacent thereto. Preferably, annular detents 22*m*, 22*n*, 22*o* are formed along and in the inner annular surface 22*l* with radial end surface 22*p* being formed adjacent the lower end 22*q* of the lower housing portion 22. The annular surface 22*r* (FIG. 2B) is formed between the radial surface 22*i* and upper end surface 22*s* of the lower housing portion 22.

Figure 3:
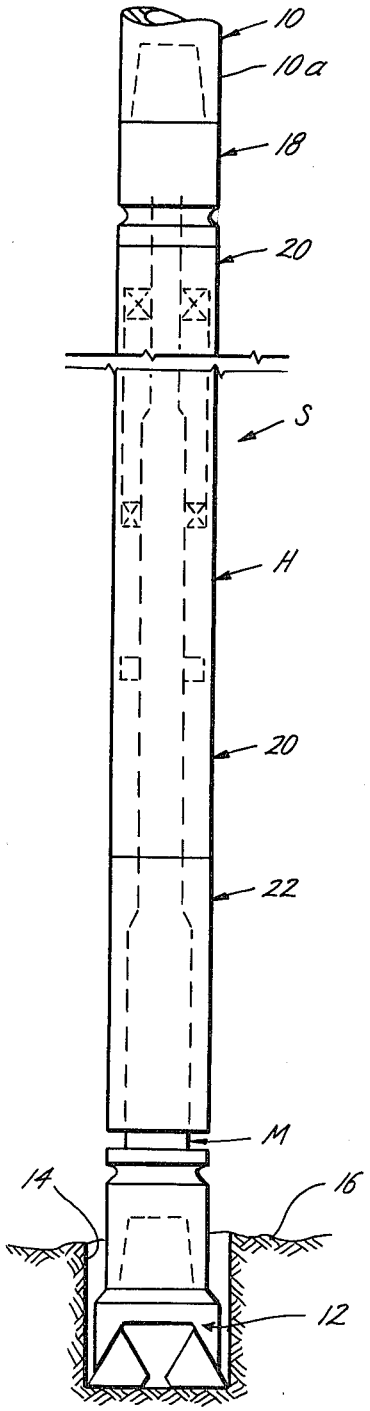

The shock absorber assembly S of the present invention further includes a mandrel M mounted with the housing H for reciprocal longitudinal movement with respect to the housing H. The mandrel M includes mandrel 24 having an outer annular surface 24*a* formed adjacent the upper end 24*b* thereof. Suitable threaded openings such as opening 24*c* are formed about the perimeter of the outer annular surface 24*a* as discussed more fully hereinbelow. End surface 24*d* (FIG. 2B) is formed adjacent the upper end 24*b* with an inner annular surface 24*e* formed adjacent thereto. Mandrel bore 24*f* is formed adjacent to inner annular surface 24*e* with a stepped portion 24*g* formed therebetween. The mandrel bore 24*f* extends along the length of the mandrel 24 to the lower end 24*h* thereof where suitable threads 24*i* are formed to permit threaded engagement of the mandrel 24 with the drill bit 12 (FIG. 1, FIG. 3). An annular tab 24*j* (FIG. 2B) is preferably formed adjacent to the outer annular surface 24*a* adjacent the upper end 24*b* of mandrel 24 with annular surface 24*k* being formed adjacent thereto.

Alternating radial end surfaces 24*l* are formed adjacent to the annular surface 24*k* and delineate the uppermost surface of the slots or splines 24*m* of the mandrel 24. Preferably, the slots or splines 24*m* are compatibly formed to permit the longitudinal movement of the mandrel 24 within the compatibly formed slots or splines 22*g* formed within the lower housing portion 22. As such, the mandrel 24 may move reciprocally along the longitudinal axis with respect to the housing H, with the engagement between slots or splines 24*m* of the mandrel 24 and slots or splines 22*g* of the lower housing portion 22 preventing any relative rotation between such members. A tapered surface 24*n* is formed adjacent to the lower portion of the slots or splines 24*m* and is adapted to compatibly engage tapered surface 22*k* of the lower housing portion 22 upon full compression of the mandrel 24 into the housing H upon extreme loading thereof discussed more fully hereinbelow. Outer annular surface 24*o* is formed adjacent to the tapered surface 24*n* and extends downwardly to radial surface 24*p* formed adjacent the lower end 24*h* of the mandrel 24.

Preferably, the shock absorber assembly S includes a suitable bearing 26, preferably formed of a metal softer than that of the housing H, is adapted to be mounted within detent 22*m* while mandrel packing 28 is mounted within detent 22*n* formed with the lower housing portion 22. Preferably, the mandrel packing 28 includes spacers 28*a*, 28*b* which may be made of asbestos or any other suitable material for securing the mandrel packing 28 in place within the packing detent 22*n*. Mandrel wiper 30 is preferably mounted within detent 22*o* for performing wiping functions as is well known and described more fully hereinbelow.

Figure 2D:
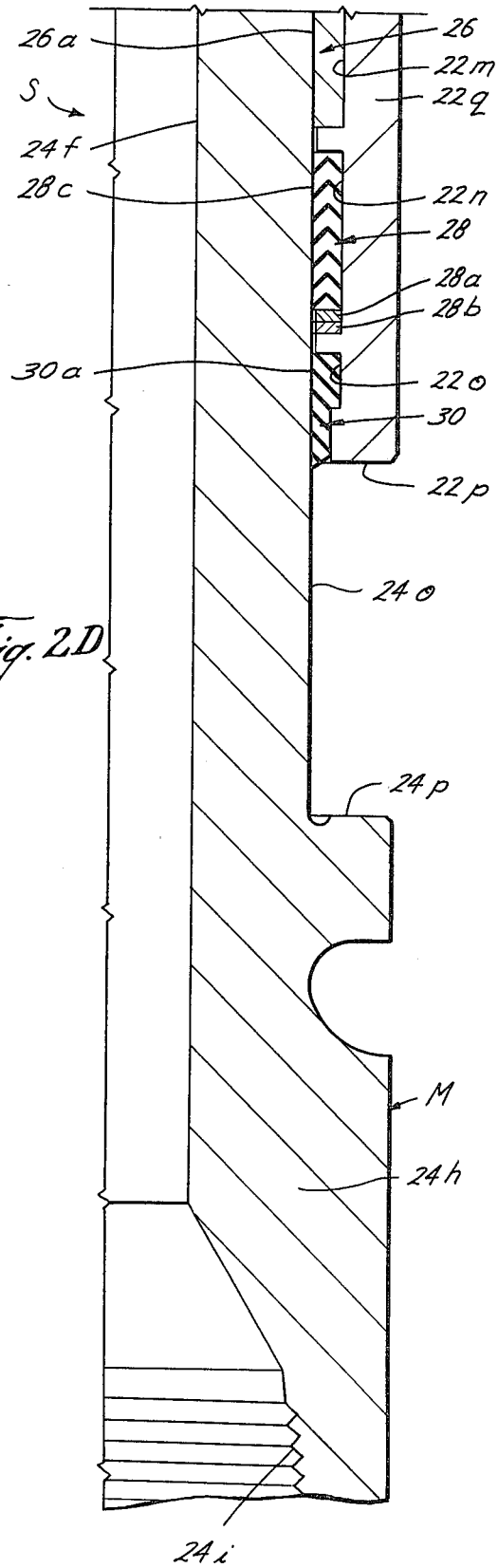
FIG. 2D is an elevational, sectional view of the shock absorber assembly of the present invention taken along lines 2D—2D of FIG. 1; and, FIG. 3 is an elevational view, similar to FIG. 1, of the shock absorber assembly of the present invention as schematically used with a drill string, with the fluid dampening means in a fully compressed position.

It will be appreciated that the inner annular surface 26*a* of the bearing 26, the inner annular surface 28*c* of the mandrel packing 28 and the inner annular surface 30*a* of mandrel wiper 30 all coact with and engage outer annular surface 24*o* of the mandrel 24 for respective bearing, packing, and wiping action therebetween as the mandrel 24 moves reciprocally within the housing H. Further, the maximum upward movement of the mandrel 24 within the lower housing portion 22 of the housing H is limited by engagement of the radial surface 24*p* (FIG. 2D) with radial end surface 22*p* of lower housing portion 22 and by engagement between tapered surfaces 24*n* of mandrel 24 and tapered surface 22*k* of lower housing portion 22. A retainer 32 (FIG. 2B) preferably is fitted about annular tab 24*j* of mandrel 24. The retainer 32 is preferably of a "split-ring" configuration, that is, formed of two arcuate halves (not shown), to permit assembly over and about the tab 24*j*. The retainer 32 is adapted to fit within the annular surface 22*r* of the lower housing portion 22. The lower end surface 32*a* of the retainer 32 is adapted to engage the radial surface 22*i* for limiting the extent of downward movement of the mandrel M with respect to the housing H as the mandrel 24 reciprocates within the intermediate and lower housing portions 20, 22 of the housing H.

The shock absorber assembly S of the present invention further includes a guide sleeve 34 (FIG. 2B) which is adapted to be disposed within the intermediate housing bore 20*e* of the intermediate housing portion 20 such that the outer annular surface 34*a* of the guide sleeve 34 is of a diameter less than the inside diameter of the bore 20*e*. Preferably, a suitable detent 34*b* is formed in the outer annular surface 34*a* of guide sleeve 34 and is adapted to receive a suitable sealing means such as O-ring 34*c* for sealably engaging the bore 20*e* of the intermediate housing portion 20. The detent 34*b* may be formed adjacent the lower end surface 34*d* of the guide sleeve 34. Preferably, the lower end surface 34*d* is adapted to engage upper end surface 22*s* of the lower housing portion 22. Furthermore, the guide sleeve 34 includes inner annular surface 34*e*.

The shock absorber assembly S of the present invention further includes upper mandrel packing means designated generally as 36 and includes packing 36*a* which is adapted to sealably pack and engage the outer annular surface 24*a* of mandrel 24 and inner annular surface 34*e* of guide sleeve 34 and mounted and secured between the retainer 32 and retaining ring 38. Preferably the retaining ring 38 is formed having suitable openings 38*a* which is adapted to threadedly receive threaded members 40 which may be threadedly received within threaded openings 38*a* of retaining ring 38 and threaded into opening 24*c* formed in mandrel 24, for securing the retaining ring 38 in proper position with respect to the mandrel 34 and to ensure proper placement and location of the packing means 36, particularly during longitudinal, reciprocal movement of the mandrel M with respect to the housing H.

The shock absorber assembly S of the present invention further includes fluid dampening means F for absorbing shocks between the mandrel M and housing H. The fluid dampening means F includes a tank member 44 and a piston member 46. The tank member 44 includes an upper portion 44*a*, a central portion 44*b*, and a lower portion 44*c*. The upper portion 44*a* is formed having an upper end surface 44*d*, inner and outer annular surfaces 44*e*, 44*f*, respectively, with radial surfaces 44*g*, 44*h* formed adjacent the lower ends thereof, respectively, and an inner annular surface 44*i* formed adjacent to radial surface 44*h*. A lower end surface 44*j* is formed adjacent to the inner annular surface 44*i*. Preferably, a suitable detent 44*k* is formed in outer annular surface 44*f* and is adapted to receive suitable sealing means such as O-ring 44*l*. Preferably, a passageway 44*m* is formed in the upper portion 44*a* of tank member 44, with such passageway 44*m* extending between the end surface 44*j* and outer annular surface 44*n*, with the passageway 44*m* having a threaded portion adjacent the outer annular surface 44*n* to receive threaded plug 44*o* as discussed more fully hereinbelow.

The tank member 44 of the fluid dampening means F further includes a central portion 44*b* that is affixed to upper portion 44*a* by means of an appropriate weldment 44*p* with the central portion 44*b* having inner annular surface 44*q* and outer annular surface 44*r*. A passageway 44*s* is formed between the inner and outer annular surfaces 44*q*, 44*r*, respectively, and adapted to threadedly receive threaded plug 44*t* adjacent the outer annular surface 44*r*.

The tank member 44 further includes a lower portion 44*c* which is attached to the central portion 44*b* by means of an appropriate weldment 44*u*, with the lower portion 44*c* including an upper end surface 44*b*, an inner annular surface 44*w*, radial surface 44*x*, interior surface 44*y*, and threads 44*z* and annular surface 44*aa* adjacent the lower end 44*bb* of the lower portion 44*c*. The lower portion 44*c* is further formed having a lower end surface 44*cc* adjacent the lower end 44*bb* with a detent 44*dd* formed adjacent thereto for receiving the guide sleeve 34 therewith and an outer annular surface 44*ee*. It will be appreciated that outer annular surface 44*ee* of the lower portion 44*c*, the outer annular surface 44*r* of the central portion 44*b*, and the outer annular surface 44*n* of upper portion 44*a* of tank member 44 are of a diameter less than that of the intermediate housing bore 20*e* of intermediate housing portion 20. Radial surfaces 44*g*, 44*x* act as packing stops as discussed more fully hereinbelow. Further, threaded plugs 44*o*, 44*t* with their respective passageways 44*m*, 44*s* form the fill means 42 of the present invention discussed below.

The fluid dampening means S further includes piston member 46 which is mounted for movement within the tank member 44. The piston member 46 is formed having a bore 46*a*, an upper end surface 46*b*, an upper outer annular surface 46*c*, a tapered surface 46*d*, a lower outer annular surface 46*e*, a lower end surface 46*f* (FIG. 2B), and an annular surface 46*g* and radial surface 46*h* adjacent thereto. The end surface 24*d* of the mandrel 24 is adapted to engage the radial surface 46*h* of the piston member 46 with the annular surfaces 24*e*, 46*g* adjacent one another, with there thus being positive engagement between the mandrel 24 and piston member 46. A suitable detent 46*i* (FIG. 2A) is formed adjacent the upper end surface 46*b* of the piston member 46 and is adapted to receive wiper means 48 which includes wiper 48*a* which may be formed of neoprene or other suitable material capable of ensuring sealing engagement therebetween the piston member 46 and the central bore 18*b* of upper housing portion 18.

The shock absorber assembly S of the present invention further includes wear pads 50, 52, 54, 56, which are preferably of a non-metallic material and act as bearings between the piston member 46 and tank member 44 as the piston member 46 reciprocates with respect to the tank member 44 as discussed more fully hereinbelow. Preferably, the wear pad 50 is positioned between the upper outer annular surface 46*c* of the piston member 46 and the inner annular surface 44*e* of the upper portion 44*a* of the tank member 44 and abuts radial lip 18*c*, with the wear pad 52 being disposed in an abutting relation with the radial surface 44*g* between surfaces 46*c* and 44*e*. Packing means designated generally as 58 is preferably disposed between wear pads 50, 52 and includes directional packing members 58*a*, 58*b*. As such, the packing means 58 is secured in place between the wear pads 50, 52 upon the wear pads 50, 52 being in an abutting relation with the radial surface 18*c* and radial surface 44*g*. In similar fashion, packing means 60 is secured between wear pads 54, 56 with the packing means 60 including directional packing members 60*a*, 60*b* with the packing means 60 being disposed between surfaces 46*e* and 44*y*. Wear pad 54 abuts radial surface 44*x* with directional packing members 60*a*, 60*b* in abutting relation thereto and abutting wear pad 56.

The shock absorber assembly S further includes a packing retainer 62 which secures the wear pad 56 in place with the end surface 62*a* of the packing retainer 62 abutting wear pad 56. The packing retainer 62 is formed having outer annular surfaces 62*b*, 62*c* with threads 62*d* formed therebetween and adapted to threadedly engage compatibly formed threads 44*c* of the tank member 44. Suitable detents 62*e*, 62*f* are formed in annular surfaces 62*b*, 62*c* for receiving appropriate sealing means such as O-rings 62*g*, 62*h* for ensuring sealing relating with surfaces 44*y*, 44*aa*, respectively. The bore 62*i* of the packing retainer 62 is of a diameter such that the outer annular surface 46*e* of the piston member 46 is of a lesser diameter than that of the bore 62*i* of the packing retainer 62. Suitable tool detents 62*j* are formed adjacent the end surface 62*k* of the packing retainer for receiving an appropriate tool (not shown), such as a spanner wrench, for threadedly securing the packing retainer 62 with the tank member 44. Preferably, an appropriate snap ring 64 is fitted into a suitable detent 44*ff* formed adjacent the end surface 44*cc* for preventing inadvertent unthreaded action of the packing retainer 62 from the tank member 44. Accordingly, the packing retainer 62 ensures that the packing means 60 is secured in place between the wear pads 54, 56 while the wear pad 54 is in a proper abutting relation with the radial surface 44*x* of the tank member 44.

As such, the shock absorber assembly S of the present invention includes a dampening fluid chamber 66 formed and defined by the end surface 44*j*, annular surface 46*c*, tapered surface 46*d*, a portion of annular surface 46*e*, radial surface 44*v*, and annular surface 44*q*. The dampening fluid chamber 66 is adapted to receive fluid, such as hydraulic oil, therein for responding to action upon the shock absorber assembly S of the present invention. As noted hereinbelow, the mandrel 24 abuts the piston 46 and any longitudinal reciprocal movement of the mandrel results in a corresponding longitudinal, reciprocal movement of the piston member 46 with respect to the tank member 44. Movement of the mandrel 24 in an upwardly direction results in movement of the tapered surface 46*d* upwardly towards radial surface 44*j*. This upward movement of the tapered surface 46*d* towards radial surface 44*j* results in a "differential area" compression of the fluid within the dampening fluid chamber 66 which effectuates dampening of shocks translated by the drill bit 12 to the mandrel M onto the piston member 46 of the fluid dampening means F of the present invention.

It should be noted that clearance is provided between the outer surfaces of the tank member 44 and the intermediate housing bore 20*e* which permits the fluid dampening means F to react, bend, or otherwise respond to compression of the fluid within the dampening fluid chamber 66, without affecting, contacting, or in any manner interfering with the intermediate housing 20 of the housing H upon extreme loading due to encountering shocks with the drill bit 12. The differential area compression allows gradual compression of fluid within the dampening fluid chamber 66 as the piston member 46 moves upwardly within the tank member 44, yet permitting loading of the fluid dampening means F in such a fashion that it is independent of stresses and strains acting upon the housing H.

Furthermore, it will be appreciated that the fluid dampening means F of the shock absorber assembly S of the present invention is capable of being replaced inasmuch as it is simply "sandwiched" between the mandrel M and the upper housing portion 18 of the housing H. Unthreading of the upper housing portion 18 from the intermediate housing portion 20 permits access to the fluid dampening means F such that the entire fluid dampening means F including the tank member 44 and piston member 46 may be replaced as a unit without requiring replacement of the housing H. Furthermore, such a replacement results in replacement of the wear pads 50, 52, 54, 56 and packing means 58, 60 as well as other wear components. After replacement thereof, threaded plug 44*o* of the fill means 42 may be removed and the fluid chamber 66 filled with an appropriate fluid by forcing such through passageway 44*m* thereinto the fluid chamber 66, with the threaded plug 44*o* being thereafter replaced. Similarly, fluid may be introduced into dampening fluid chamber 66 by removal of threaded plug 44*t* of the fill means 42 and forcing such fluid through passageway 44*s*. The plural passageways 44*m*, 44*s* and their respective threaded plugs 44*o*, 44*t* of the fill means allow the injection of suitable dampening fluid into the dampening fluid chamber 66 and the appropriate "bleeding" of any trapped air during the injection process. By varying the volume and type of dampening fluids used within the dampening fluid chamber 66, varying dampening rates may be achieved.

Thus, the shock absorber assembly of the present invention provides a fluid dampening means F that is separate and apart from the housing H and may be simply removed, repaired and/or replaced as is needed during operation thereof while permitting reuse of the housing H and mandrel M.

The working fluid, such as drilling mud by way of example, used during drilling operations may be easily circulated through the central bore of the housing H to the drill bit 12 by fluid communication between the drill string 10*c*, through bores 18*b*, 46*a*, 24*f* of the housing H, fluid dampening means F, and mandrel M, respectively, thereinto drill bit 12 for use thereof in drilling operations. Shock loading encountered or caused by the drilling string 10 or drill bit 12 during drilling operations with the drill string 10 cause responsive action of the mandrel M in engagement with the piston member 46 relative to the housing H which results in compression of the dampening fluid within the dampening fluid chamber 66 for absorbing and dissipating the shock or shocks so encountered. Upon the release of such loading, the fluid within the dampening fluid chamber 66 thereafter expands forcing the piston member 46, mandrel M and drill bit 12 downwardly with respect to the housing H for resuming non-shock loaded drilling operations. Thus, the housing H of the shock absorber assembly S need not be capable of absorbing or holding the requisite compressive pressures required for dampening in addition to other tool stresses, strains and pressures necessary in drilling thus resulting in a unit that may be easily repaired and cost effective.

The foregoing disclosure and description of the invention are illustrative and explanatory thereof, and various changes in the size, shape and materials, as well as in the illustrated construction thereof, may be made without departing from the spirit of the invention.

I claim:

1. A shock absorber assembly for use with a drill string having working fluid therein, comprising:

a housing formed having a central bore therethrough;

said housing having an upper housing portion, an intermediate housing portion and a lower housing portion;

said upper housing portion affixed to the drill string and in communication with the working fluid;

said intermediate housing portion having an intermediate bore of a greater inside diameter than said central bore;

a mandrel mounted with said housing for reciprocal longitudinal movement with respect to said housing;

said mandrel having a mandrel bore in communication with said central bore for permitting flow of working fluid therethrough; and, fluid dampening means for absorbing shocks between said mandrel and said housing, said fluid dampening means having a working fluid bore therethrough for permitting flow of the working fluid therethrough, said fluid dampening means replaceably sandwiched between said upper housing portion and said mandrel within said intermediate bore of said intermediate housing portion.

2. The shock absorber assembly of claim 1, wherein said fluid dampening means includes:

a tank member abutting said upper housing portion and said lower housing portion, said tank member adapted to be disposed within said intermediate bore of said intermediate housing portion, said tank member having an inner annular surface; and, a piston member mounted for movement within said tank member, said piston member having an outer surface of a diameter smaller than said inner annular surface for forming a dampening fluid chamber between said outer surface of said piston member and said inner annular surface of said tank member, said dampening fluid chamber for receiving dampening fluid therein.

3. The shock absorber assembly of claim 2, further including:

packing means disposed between said tank member and said piston member for maintaining said dampening fluid within said dampening fluid chamber and for preventing unwanted migration of working fluid into said dampening fluid chamber.

4. The shock absorber assembly of claim 3, wherein:

said tank member is formed having a packing stop extending radially inwardly from said inner annular surface; and, said packing means abuts said packing stop.

5. The shock absorber assembly of claim 4, further including:

a packing retainer threadedly affixed with said tank member for securing said packing means between said packing stop and said packing retainer.

6. The shock absorber assembly of claim 2, further including:

a guide sleeve disposed within said intermediate bore between said lower housing and said tank member for guiding reciprocal movement of said mandrel and said piston member within said housing.

7. The shock absorber assembly of claim 6, further including:

upper mandrel packing means disposed between said guide sleeve and said mandrel for preventing unwanted migration of working fluid therebetween.

8. The shock absorber assembly of claim 2, further including:

wiper means with said outer surface of said piston member and in engagement with said central bore of said housing for preventing unwanted fluid migration therebetween.

9. The shock absorber assembly of claim 2, further including:

fill means with said tank member for permitting the filling and withdrawing of dampening fluid from said dampening fluid chamber as desired.

10. The shock absorber assembly of claim 2, wherein said outer surface of said tubular piston member includes:

an upper annular surface, a lower annular surface, and a conical surface therebetween said upper and lower annular surfaces, with said upper annular surface having a smaller outside diameter than the outside diameter of said lower annular surface.

11. The shock absorber assembly of claim 10, wherein:

said conical surface provides a differential area for differential compression of said dampening fluid within said fluid dampening means.

* * * * *